United States Patent [19]

Nagashima et al.

[11] 4,054,712

[45] Oct. 18, 1977

[54] TONER IMAGE RECEIVING SHEET WITH COLOR FORMING AGENTS

[75] Inventors: Shinichiro Nagashima, Tokyo; Kaichi Tsuchiya, Fuchu; Yoshihiro Sakamoto; Hiroshi Yamakami, both of Tokyo; Seiji Tomari, Yokohama, all of Japan

[73] Assignee: Canon Kabushiki Kaisha, Tokyo, Japan

[21] Appl. No.: 560,508

[22] Filed: Mar. 20, 1975

Related U.S. Application Data

[62] Division of Ser. No. 305,672, Nov. 13, 1972, Pat. No. 3,879,196.

[30] Foreign Application Priority Data

| | | |
|---|---|---|
| Nov. 15, 1971 | Japan | 46-91246 |
| June 5, 1972 | Japan | 47-55780 |
| July 10, 1972 | Japan | 47-68786 |

[51] Int. Cl.[2] ..... B32B 7/00

[52] U.S. Cl. ..... 428/262; 428/263; 428/264; 428/265; 428/414; 428/418; 428/454; 428/458; 428/460; 428/461; 252/62.1 P; 96/1.2; 96/1.6; 96/1.8; 428/463; 428/464; 428/481; 428/483; 428/287; 428/478; 428/488; 428/518; 428/519; 428/520; 428/908; 428/283; 428/290; 428/285

[58] Field of Search ..... 428/411, 519, 518, 454, 428/908, 520, 478, 488, 464, 463, 461, 458, 418, 414, 481, 483, 460, 240, 242, 262-265; 96/1.2, 1.6; 252/62.1, 62.1 P

[56] References Cited

U.S. PATENT DOCUMENTS

| | | | |
|---|---|---|---|
| 2,618,551 | 11/1952 | Walkup | 95/1.9 |
| 2,986,521 | 5/1961 | Wielicki | 252/62.1 |
| 3,241,957 | 3/1966 | Fauser et al. | 96/1 |
| 3,666,525 | 5/1972 | Kimura et al. | 260/345.2 |
| 3,893,932 | 7/1975 | Azar et al. | 252/62.1 |
| 3,916,069 | 10/1975 | Tiers et al. | 428/411 |

*Primary Examiner*—P. C. Ives
*Attorney, Agent, or Firm*—Fitzpatrick, Cella, Harper & Scinto

[57] ABSTRACT

An electrophotographic method comprises developing an electric latent image formed on a photosensitive member comprising a photoconductive material and containing a first color forming agent in a surface for forming a visible image with a charged toner particle containing a second color forming agent, and heating to cause a thermal color forming reaction therebetween resulting in formation of a colored fixed image on the photosensitive member.

13 Claims, 7 Drawing Figures

TONER IMAGE RECEIVING SHEET WITH COLOR FORMING AGENTS

This is a division, of application Ser. No. 305,672, filed Nov. 13, 1972; now U.S. Pat. No. 3,879,196, Issued on: Apr. 22, 1975.

BACKGROUND OF THE INVENTION

1. Field of the Invention

This invention relates to a novel color forming electrophotographic method utilizing a toner for electrostatic image containing a color forming agent (A) and a photoconductive photosensitive member or an image receiving sheet containing a color forming agent (B), and further to a particular electrophotographic material used therefor.

2. Description of the Prior Art

Heretofore, there have been known various electrophotographic processes such as those disclosed in U.S. Pat. No. 2,297,691, Japanese Pat. Publication No. 23910/1967 and Japanese Pat. Publication No. 24748/1968. In general, these electrophotographic processes comprise utilizing a photoconductive material, forming electric latent images on a photosensitive member, developing the latent images with a toner, if desired, transferring the developed image to an image receiving sheet such as paper and fixing the transferred image by heating or with solvent vapor.

It is widely known to use, as a developing toner, finely divided particles of 1 – 20 microns in diameter composed of a coloring pigment such as carbon black dispersed in a binder resin such as styrene resin. Such a toner is usually mixed with a carrier material such as glass beads, iron powder, fur and the like, or dispersed in an insulating liquid, and then attracted to or repulsed by the electrostatic latent image to visualize the negative or positive electric image.

The above-mentioned prior arts have the following three problems. The first problem is smudging during manufacturing and development since the toner is finely divided black powder. Such finely divided toner is so light that the toner is easily blown up to dirty one's hands, feet and clothes as well as room, and further to cause dust pollution outdoors.

The second problem is the main improving point of this invention. Hitherto, a copy image has almost been black color and it has been very difficult to form various color images such as red or blue by only one printer. The most difficult point was to prepare various color toner by adding various colored pigment or dyestuff to a thermoplastic resin which is a main raw material of a toner. When a pigment or dyestuff was added, charge of a toner was changeable, and a quality of an image fell down. Furthermore, even if such developing agent is prepared, since a developing agent must be exchanged in accordance with the desired color, an exchanging time of a developing agent, scattering of a toner of fine powder, soiling by a developing agent and the like became an issue. At present, black colored toner is only used and the various colored toners are not used in practice.

The third problem is concerned with fixation. In general, toner is fixed by heating, but when a switch is turned on and then immediately the reproduction operation starts, fixation of the resulting image is incomplete and when rubbed, the toner is easily removed. Thus, the fixed portion is preliminarily heated and brought to a sufficient temperature, and then the reproduction operation can start. Particularly, a necessary preliminary heating time is usually 5 – 10 minutes for dry reproduction machine, and once the machine is switched on, the fixing device should be kept at a constant temperature until the business time is finished.

As an electrophotographic method using a color forming system, there may be mentioned that disclosed in Japanese Pat. Publication No. 15912/1966 which comprises covering a diazonium compound with wax and the like and combining with a paper coated with a coupler, that disclosed in Japanese Pat. Publication No. 989/1967 and Japanese Pat. Publication No. 3837/1970 which comprises using a volatile first chemical material as toner and a second chemical material (metal salt) as a reproduction sheet to form a colored image. However, when a diazonium compound is used as toner, there is disadvantageously a danger of explosion during pulverizing procedure and further, an alkali treatment is necessary upon forming color, and therefore, it is not practical. Furthermore, in a system using a metal salt it is difficult to obtain clear and sharp color.

SUMMARY OF THE INVENTION

This invention provides an electrophotographic method which can solve the above-mentioned drawbacks of prior art and in which a toner is colorless or of light color and a completely fixed image can be obtained without any waiting time in dry type developing.

An object of this invention is to provide a novel color forming electrophotographic method comprising forming a developed image on an image receiving sheet containing a color forming agent (B) infra by using a toner for electrostatic image containing a color forming agent (A) infra and applying a heating color forming treatment to form a visible image.

Another object of this invention is to provide an electrographic method that various colored images can be formed by changing the kind of receiving image sheet even if the same toner is used.

A further object of this invention is to provide a colorless or light color toner for electrostatic image containing a color forming agent (A) infra which can form color by heating together with a color forming agent (B) infra.

A still further object of this invention is to provide an image receiving sheet containing a color forming agent (B) infra used for transferring an image formed by a toner for electrostatic image containing a color forming agent (A) infra.

Still another object of this invention is to provide an electrostatic transferring paper containing a color forming agent (B) infra.

This invention is an electrographic method which comprises developing an electric latent image formed on a photosensitive member comprising a photoconductive material and containing a color forming agent (B) infra in a surface for forming a visible image with a charged toner particle containing a color forming agent (A) infra, and heating to cause a thermal color forming reaction between the color forming agent (A) in the toner and the color forming agent (B) in the photosensitive member resulting in formation of a colored fixed image on the photosensitive member.

According to another aspect of this invention, there is provided an electrophotographic method as mentioned above in which the toner particle contains the color forming agent (A) and a color forming auxiliary agent having a melting point ranging from 40° to 130° C selected from the group consisting of fatty acid, fatty acid metal salt, fatty acid ester, fatty acid amide, fatty acid anilide and solid plasticizer.

According to a further aspect of this invention, there is provided an electrophotographic method as mentioned above in which the visible image forming surface of the photosensitive member contains the color forming agent (B) and a color forming auxiliary agent having a melting point ranging from 40° to 130° C selected from the group consisting of fatty acid, fatty acid metal salt, fatty acid ester, fatty acid amide, fatty acid anilide and solid plasticizer.

This invention is an electrophotographic method characterized in that it comprises developing an electric latent image formed on a photosensitive member using a photoconductive material with charged toner particles containing a material selected from a color forming agent (A) group infra, transferring the resulting toner image to an image receiving sheet containing a material selected from a color forming agent (B) group infra, and heating to cause a thermal color forming reaction between the color forming agent (A) in the toner and the color forming agent (B) in the image receiving sheet resulting in formation of a colored fixed image on the image receiving sheet.

According to a still further aspect of this invention, there is provided an electrophotographic method as mentioned above in which the toner particle contains the color forming agent (A) and a color forming auxiliary agent having a melting point ranging from 40° to 130° C selected from the group consisting of fatty acid, fatty acid metal salt, fatty acid ester, fatty acid amide, fatty acid anilide and solid plasticizer.

According to still another object of this invention, there is provided an electrophotographic method as mentioned above in which the visible image forming surface of the photosensitive member contains the color forming agent (B) and a color forming auxiliary agent having a melting point ranging from 40° to 130° C selected from the group consisting of fatty acid, fatty acid metal salt, fatty acid ester, fatty acid amide, fatty acid anilide and solid plasticizer.

According to a still further aspect of this invention, there is provided an electrostatic recording method which comprises developing an electric latent image formed on an electrostatic recording paper containing a color forming agent (B) in the visible image forming surface with a charged toner particle containing a color forming agent (A), and heating to cause a thermal color forming reaction the color forming agent (A) in the toner and the color forming agent (B) in the electrostatic recording paper resulting in formation of a colored fixed image.

According to still another aspect of this invention, there is provided an electrostatic recording method as mentioned above in which the toner particle contains the color forming agent (A) and a color forming auxiliary agent having a melting point ranging from 40° to 130° C selected from the group consisting of fatty acid, fatty acid metal salt, fatty acid ester, fatty acid amide, fatty acid anilide and solid plasticizer.

According to a still further aspect of this invention, there is provided an electrostatic recording method as mentioned above in which the visible image forming surface of the photosensitive member contains the color forming agent (B) and a color forming auxiliary agent having a melting point ranging from 40° to 130° C selected from the group consisting of fatty acid, fatty acid metal salt, fatty acid ester, fatty acid amide, fatty acid anilide and solid plasticizer.

According to still another aspect of this invention there is provided a recording method which comprises closely contacting a master sheet having a toner image containing a color forming agent (A) with a visible image forming surface containing a color forming agent (B) of an image receiving sheet and heating to cause a thermal color forming reaction between the color forming agent (A) and the color forming agent (B) resulting in a visible image.

According to a still further aspect of this invention, there is provided a recording method as mentioned above in which the toner image contains the color forming agent (A) and a color forming auxiliary agent having a melting point ranging from 40° to 130° C selected from the group consisting of fatty acid, fatty acid metal salt, fatty acid ester, fatty acid amide, fatty acid anilide and solid plasticizer.

According to still another aspect of this invention, there is provided a recording method as mentioned above in which the visible image forming surface of an image receiving sheet contains the color forming agent (B) and a color forming auxiliary agent having a melting point ranging from 40° to 130° C selected from the group consisting of fatty acid, fatty acid metal salt, fatty acid ester, fatty acid amide, fatty acid anilide and solid plasticizer.

According to a still further aspect of this invention, there is provided a toner for electrostatic image which comprises containing in a binder resin a material selected from the color forming agent (A) group infra.

According to still another aspect of this invention, there is provided a toner for electrostatic image as mentioned above in which the binder resin contains the color forming agent (A) and a color forming auxiliary agent having a melting point ranging from 40° to 130° C selected from the group consisting of fatty acid, fatty acid metal salt, fatty acid ester, fatty acid amide, fatty acid anilide and solid plasticizer.

According to a still further aspect of this invention, there is provided an electrophotographic photosensitive member which comprises a photoconductive material and a visible image forming surface of the photosensitive member containing a material selected from the color forming agent (B) group infra.

This invention is a photosensitive member for an electrography comprising a photoconductive material and containing a material selected from the color forming agent (B) group infra in a surface for forming a visible image.

Furthermore, this invention is a photosensitive member for an electrography in which the visible image forming surface of the photosensitive member contains the color forming agent (B) and a color forming auxiliary agent having a melting point ranging from 40° to 130° C selected from the group of fatty acid, fatty acid metal salt.

According to a still further aspect of this invention, there is provided an image receiving sheet which comprises a visible image forming surface containing a material selected from the color forming agent (B) group infra.

According to still another aspect of this invention, there is provided an image receiving sheet as mentioned above in which the visible image forming surface contains the color forming agent (B) and a color forming auxiliary agent having a melting point ranging from 40° to 130° C selected from the group consisting of fatty acid, fatty acid metal salt, fatty acid ester, fatty acid amide, fatty acid anilide and solid plasticizer.

According to a still further aspect of this invention, there is provided an electrostatic recording paper which comprises a support layer and an electrostatic recording layer overlying the support layer and containing a material selected from the color forming agent (B) group infra.

According to still another aspect of this invention, there is provided an electrostatic recording paper as mentioned above in which the electrostatic recording layer contains the color forming agent (B) and a color forming auxiliary agent having a melting point ranging from 40° to 130° C selected from the group consisting of fatty acid, fatty acid metal salt, fatty acid ester, fatty acid amide, fatty acid anilide and solid plasticizer.

A color forming agent (A) used in this invention is selected from the following group:

1. Polymer of phenol and aldehyde,
2. Polymer of phenol and acetylene,
3. rosin modified maleic acid resin,
4. hydrolyzed product of copolymer of styrene and maleic anhydride,
5. hydrolyzed product of polymer of carboxy polyethylene,
6. hydrolyzed product of copolymer of vinyl methyl ether and maleic anhydride,
7. hydrolyzed product of copolymer of ethylene and maleic anhydride,
8. Japanese acid clay,
9. bentonite,
10. diatomaceous earth,
11. bisphenol compounds containing carboxyl radical,
12. polymers of bisphenol compounds containing carboxyl radical in a molecule, and
13. phenolic material.

A color forming agent (B) used in this invention is selected from the following group:

1. diarylphthalides,
2. leuco auramines,
3. acryl auramines,
4. $\alpha$, $\beta$-unsaturated arylketones,
5. basic monoazo dyestuff,
6. rohdamine B lactone,
7. polyarylcarbinols,
8. benzoindolino spiropyranes,
9. phthalans, and
10. spirophthalans.

DESCRIPTION OF THE PREFERRED EMBODIMENTS

Figure 1:
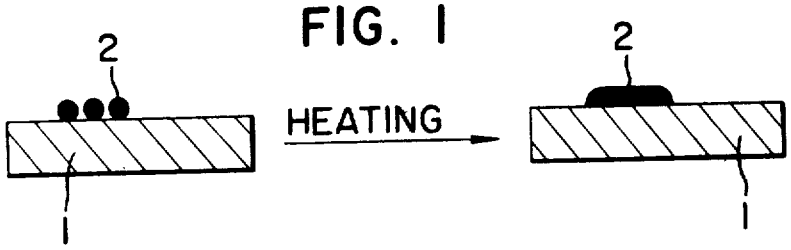
FIG. 1 shows diagrammatically a conventional fixing procedure.

The color forming agent (B) used in the present invention is basic material having a color forming group. Representative color forming agents (B) are shown below.

1. Diaryl phthalides:
   3,3-bis(p-dimethylaminophenyl)-6-dimethylamino phthalide (Crystal Violet Lactone),
   3,3-bis(p-dimethylaminophenyl)-phthalide (Malachite Green Lactone) and the like.
2. Leuco auramines:
   N-halophenyl derivatives,
   N-alkylhalophenyl derivatives,
   N-(2,5-dichlorophenyl) leuco auramine, and the like.
3. Acryl auramines:
   N-benzoyl auramine,
   N-acetyl auramine, and the like.
4. $\alpha$, $\beta$-unsaturated arylketones:
   Dianisylidene acetone,
   Dibenzylidene acetone,
   Anisylidene acetone, and the like.
5. Basic monoazo dye:
   p-dimethylaminoazobenzene-0-carboxylic acid (Methyl Red),
   4-aminoazobenzene (Oil Yellow - AAB),
   4-phenylazo-1-naphthylamine, and the like.
6. Rhodamine B lactone:
   N (p-nitrophenyl)-rhodamine B lactone,
   3,6'-diamino rhodamine B lactone,
   3,6'-diethylamino rhodamine B lactone,
   3,6'-dimethylamino rhodamine B lactone, and the like.
7. Polyaryl carbinols:
   Bis-(p-dimethylamino phenyl) methanol (michler's hydrol),
   Crystal Violet Carbinol,
   Malachite Green Carbinol, and the like.
8. Benzoindolino spiropyrans:
   8'-methoxy benzoindolino spiropyran,
   4,7,8'-trimethoxy benzoindolino spiropyran,
   6'-chloro-8'-methoxy benzoindolino spiropyran and the like.
9. Phthalans:
   1,1-bis(p-aminophenyl)phthalan,
   1,1-bis(p-benzylaminophenyl)phthalan,
   1,1-bis(p-dibenzylaminophenyl)phthalan,
   1,1-bis(p-N-methylamilinophenyl)phthalan, and the like.
10. Sprirophthalans:
   6,6'-diaminospiro (phthalan-1,9'-xanthen),
   6,6'-diethylaminospiro (phthalan-1,9'-xanthen),
   6,6'-dimethylaminospiro (phthalan-1,9'-xanthen) and the like.

Among the color forming agents (A) used in this invention, examples of (11) bisphenol compounds containing carboxyl radical in a molecule are:

(1)

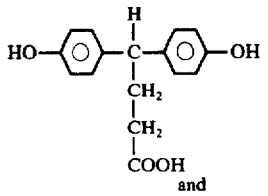

(mp. 90° C)

and (2)

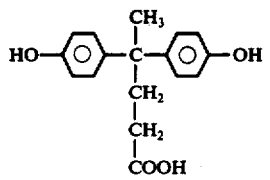

(mp. 85° C)

Further, examples of (12) polymers of bisphenol compounds containing carboxyl radical in a molecule are:

(3)

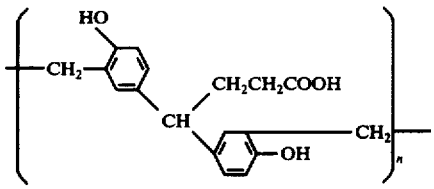

(softening point 95° - 105° C, average degree of polymerization 30 - 35)

(4)

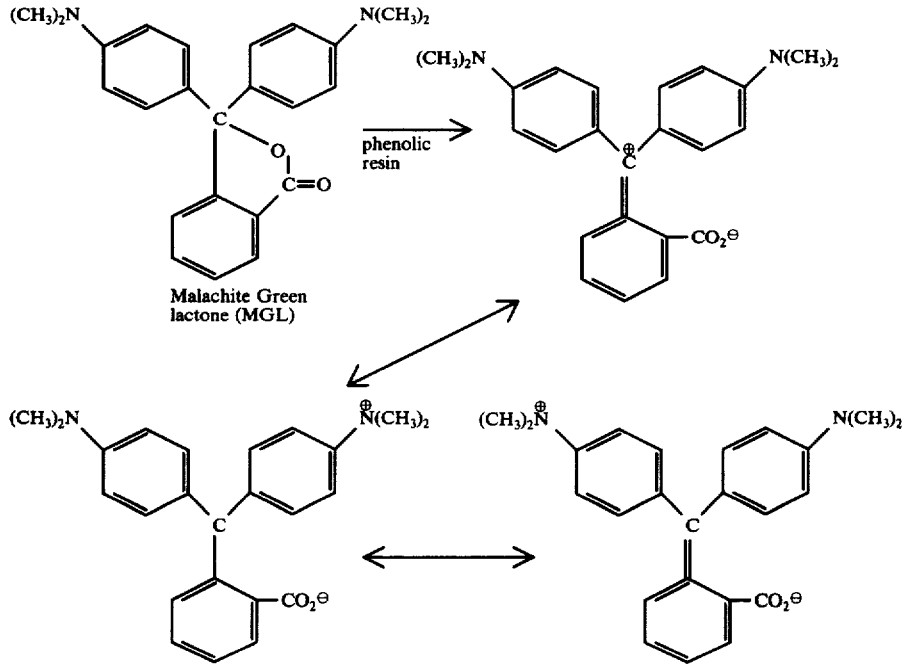

and (4)

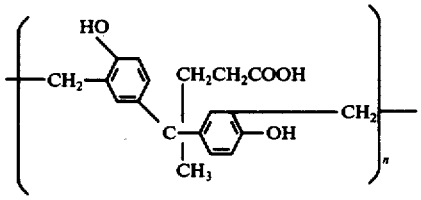

(Softening point 96° - 109° C, average degree of polymerization 40 - 45).

Furthermore, examples of (A) phenolic material are shown below:

4-tertiary-butyl phenol,
4-β-tertiary-amyl phenol,
4-phenyl phenol,
4,4'-isopropylidene-bis-(2-chloro phenol),
4,4'-isopropylidene-bis-(2-methyl phenol),
4,4'-isopropylidene-bis-(2-tertiary butyl phenol),
4,4'-secondary-butylidene-bis-(2-methyl phenol),
2,2'-dihydroxy diphenyl,
4,4'-secondary-butylidene diphenol,
4-tertiary-octyl catechol,
4-hydroxy aceto phenone,
methyl-4-hydroxy benzoate,
4-hydroxy diphenoxide,
α-naphthol,
β-naphthol,
4-hydroxy diphenyl oxide,
2,2'-methylene-bis-(4-chloro phenol),
2,2'-methylene-bis-(4-methyl-6-tertiary-butyl phenol),
4,4'-isopropylidene-bis-(2,6-dibromo phenol),
4,4'-isopropylidene-bis-(2,6-dimethyl phenol),
4,4'-cyclohexylidene diphenol,
4,4'-cyclohexylidene-bis-(2-methyl phenol).

The reaction of the color forming agent (A) and the color forming agent (B), a kind of base-acid reactions, according to the present invention, is illustrated by using a combination of malachite green lactone and phenolic resin as an example.

The color forming agent (A) and the color forming agent (B) react mutually to form color.

These materials are described detail in the Japanese Pat. Publication No. 10788/1965, No. 9309/1965, No. 9310/1965, No. 3257/1967, No. 9071/1969, No. 10318/1969 and No. 11634/1969, and may be clearly used as a color forming main agent for the electrographic method of this invention.

Conventional electrophotographic methods are applicable to the production of electric latent image in the present invention. For example, there may be mentioned conventional electrophotographic methods such as Carlson process comprising charging a whole surface of photoconductive layer composed of selenium, CdS, ZnO or an organic photoconductive material and then projecting a light image to form an electrostatic latent image and a method disclosed in Japanese patent publication No. 23910/1967 or 24748/1968 comprising uniformly charging a photosensitive member composed of a photoconductive layer such as selenium and CdS and an insulating layer such as polyester overlying the photoconductive layer, applying corona charging simultaneously with imagewise exposure, and applying blanket exposure.

The electrostatic latent image thus obtained may be developed by a conventional developing method such as cascade developing methods, magnetic brush developing methods, fur brush developing methods and liquid developing methods, by using a toner having charge opposite to that of the electrostatic latent image. In some particular cases, there may be used a toner having the same charge as that of the electrostatic latent image.

In the electrographic method according to the present invention, agent (A) alone in a form of finely divided particles as toner to form an image, but the chargeability is poor and fog forms and moreover, color forming property is poor. Furthermore, there is formed sometimes are image composed of both negative and positive images. The thermal conductivity is so low that melting by heating is not sufficient and color forming efficiency is poor and the density of the resulting image is low. High fixing temperature is necessary and further, the color forming dye directly contacts atmosphere to cause deterioration of the color forming agent (A) due to moisture and oxygen.

The present inventors have successfully eliminated such disadvantages by dispersing the color forming agent (A) in a resin of relatively low melting point such as from 70° to 130° C which has been used as a binder resin for an electrophotographic toner, such as vinsol resin, cumarone resin, polystyrene, polyvinyl acetate, polyvinyl chloride, polyethylene, polyacrylic acid ester, polyvinyl acetal, polyvinylidene chloride, polyethylene terephthalate, alkyd resin, phenolic resin, polyamide resin, epoxy resin, polypropylene, mixtures thereof, and copolymers thereof, the resulting toner for development has a highly improved chargeability.

For the purpose of improving further color forming efficiency and low temperature fixing efficiency, the color forming agent (A) and the binder resin are sufficiently melted at a certain temperature to cause a reaction with the color forming agent (B) on the photosensitive member or the transferring support. It has been now found that addition of a color forming auxiliary agent capable of low temperature fixation and improving the image density to attain the purpose.

The color forming auxiliary agent has a melting point ranging from 40° to 130° C selected from the group consisting of fatty acid, fatty acid metal salt, fatty acid ester, fatty acid amide, fatty acid anilide and solid plasticizer. These color forming auxiliary agent are mutually soluble with a binder resin, a color forming agent (A) and a color forming agent (B).

Representative color forming auxiliary agents are as shown below.

1. Fatty acids compounds, for example,

| | |
|---|---|
| Lauric acid | (44° C) |
| Tridecylic acid | (45.5° C) |
| Myristic acid | (58° C) |
| Pentadecylic acid | (53 - 54° C) |
| Palmitic acid | (63 - 64° C) |
| Heptadecylic acid | (60 - 61° C) |
| Stearic acid | (71.5 - 72° C) |

-continued

| | |
|---|---|
| Nonadecanoic acid | (68.7° C) |
| Arachic acid | (77° C) |
| Behenic acid | (81 - 82° C) |
| Lignoceric acid | (83.5° C) |
| Cerotic acid | (87.9° C) |
| Heptacosanoic acid | (82° C) |
| Montanic acid | (89.3° C) |
| Melissic acid | (93.5 - 94° C) |
| Lacceric acid | (95 - 96° C) |
| and the like. | |

The numbers in the parenthese are melting points. The preferable color forming auxiliary agents are fatty acids containing 12 or more carbon atoms and having melting points ranging from 40° to 100° C.

2. Metallic salts of fatty acids having melting points ranging from 40° to 130° C are shown by the following general formula:

$$(R\,C\,O\,O)_n\,M$$

where $n = 1 - 3$; M is Be, Mg, Ba, Zn, Cd, Hg, Al, Tl, Pb and the like; R is an alkyl radical.

Representative examples are as follows:

| | |
|---|---|
| Lead caproate | (m.p. 73 - 74° C) |
| Lead enanthate | (m.p. 78° C) |
| Lead caprylate | (m.p. 83 - 84° C) |
| Lead pelargonate | (m.p. 94 - 95° C) |
| Lead caprate | (m.p. 100° C) |
| Lead laurate | (m.p. 106° C) |
| Lead myristate | (m.p. 108.6° C) |
| Lead palmitate | (m.p. 112° C) |
| Lead stearate | (m.p. 116 - 125° C) |
| Lead tridecylate | (m.p. 128° C) |
| Aluminium stearate | (m.p. 105° C) |
| Beryllium stearate | (m.p. 45° C) |

3. Fatty acid derivatives having melting points ranging from 40° to 130° C, which are represented by the following formula:

$$R-\underset{\underset{O}{\|}}{C}-OR'$$

where R is alkyl; R′ is alkyl or aryl. Representative examples are as follows:

| | |
|---|---|
| (i) Methyl esters: | |
| Methyl arachinate | (m.p. 46 - 47° C) |
| Methyl behenate | (m.p. 54° C) |
| Methyl lignocerate | (m.p. 56.7 - 57° C) |
| Methyl cerotinate | (m.p. 63° C) |
| Methyl heptacosanate | (m.p. 64° C) |
| Methyl montanate | (m.p. 68.5° C) |
| Methyl melissinate | (m.p. 71.5° C) |
| (ii) Ethyl esters: | |
| Ethyl arachinate | (m.p. 42° C) |
| Ethyl behenate | (m.p. 50° C) |
| Ethyl lignocerate | (m.p. 56.7 - 57° C) |
| Ethyl cerotinate | (m.p. 60° C) |
| Ethyl montanate | (m.p. 64 - 65° C) |
| Ethyl melissinate | (m.p. 70.5° C) |
| Ethyl laccerate | (m.p. 76° C) |
| (iii) Phenyl esters: | |
| Phenyl arachinate | (m.p. 58.5° C) |
| Phenyl palmitinate | (m.p. 45° C) |
| (iv) Glycol esters: | |
| Glycol myristate | (m.p. 64° C) |
| Glycol palmitinate | (m.p. 51.5° C) |
| Glycol stearate | (m.p. 58 - 75° C) |
| (v) Glycerol esters: | |
| Glycerol laurate | (m.p. 63° C) |
| Glycerol myristate | (m.p. 56 - 70.5° C) |
| Glycerol palmitinate | (m.p. 34 - 77° C) |
| Glycerol stearate | (m.p. 54 - 71° C) |

4. Fatty acid derivatives having melting points ranging from 40° to 130° C, which are represented by the following formula:

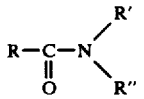

where R is alkyl; R′ and R″ is H, alkyl, or aryl. Representative examples useful for this invention are as follows:

| | |
|---|---|
| (i) Amides: | |
| Acetic amides | (m.p. 82 - 83° C) |
| Propionic amide | (m.p. 81.8° C) |
| Butyric amide | (m.p. 115 - 116° C) |
| Valeric amide | (m.p. 106° C) |
| Caproic amide | (m.p. 101° C) |
| Enantic amide | (m.p. 93 - 94° C) |
| Caprinic amide | (m.p. 105.9° C) |
| Peralgonoic amide | (m.p. 98.9° C) |
| Undecylic amide | (m.p. 84.5 - 85.5° C) |
| Lauric amide | (m.p. 102.4° C) |
| Tridecylic amide | (m.p. 100° C) |
| Myristic amide | (m.p. 105.1° C) |
| Pentadecylic amide | (m.p. 102° C) |
| Palmitic amide | (m.p. 107° C) |
| Heptadecylic amide | (m.p. 108 - 109° C) |
| Stearic amide | (m.p. 109.7° C) |
| Arachic amide | (m.p. 108° C) |
| Behenic amide | (m.p. 111 - 112° C) |
| Cerotic amide | (m.p. 109° C) |
| Montanic amide | (m.p. 112° C) |
| (ii) Anilides: | |
| Valeric anilide | (m.p. 68° C) |
| Caproic anilide | (m.p. 92° C) |
| Caprylic anilide | (m.p. 55° C) |
| Peralgonic anilide | (m.p. 57.5° C) |
| Capric anilide | (m.p. 62.5° C) |
| Undecylic anilide | (m.p. 71° C) |
| Lauric anilide | (m.p. 77.2° C) |
| Myristic anilide | (m.p. 84° C) |
| Palmitic anilide | (m.p. 90.2° C) |
| Stearic anilide | (m.p. 94° C) |
| Behenic anilide | (m.p. 101 - 102° C) |
| (iii) N-Methyl amides: | |
| Capric methyl amide | (m.p. 57.8° C) |
| Lauric methyl amide | (m.p. 62.4° C) |
| Myristic methyl amide | (m.p. 78.4° C) |
| Palmitic methyl amide | (m.p. 85.5° C) |
| Stearic methyl amide | (m.p. 92.1° C) |
| (iv) N-Dodecylic amides: | |
| Lauric dodecyl amide | (m.p. 77 - 77.5° C) |
| Myristic dodecyl amide | (m.p. 84 - 85° C) |
| Palmitic dodecyl amide | (m.p. 82.5 - 85° C) |
| Stearic dodecyl amide | (m.p. 85 - 85.5° C) |

5. Solid plasticizers, for example, diphenyl phthalate, dicyclohexyl phthalate, ethylene glycol dibenzoate, and dimethyl isophthalate.

Addition of the color forming auxiliary agent results in high color forming efficiency, good low temperature fixation, and colored image copy having sharp and sufficient density. Such improvement is considered due to that the color forming auxiliary agent melts at relatively low temperature and the color forming agent (A) and the binder resin and further the color forming agent (B) in the photosensitive member or transferring paper are mutually soluble with the color forming auxiliary agent to cause coloring and fixing at a low temperature and enhance the color forming density.

It has been further found from experiments shown later that the color forming auxiliary agent gives a good result when the color forming auxiliary agent is added together with the color forming agent (B) to a visible image forming surface of the electrophotographic photosensitive member or image receiving sheet.

The amount of the color forming auxiliary agent is usually more than 5 parts preferred with 5 - 20 parts, particularly preferred with 8 - 12 parts, per 100 parts of the color forming agent (A).

Then when the color forming auxiliary agent is added to the visible image forming surface of the receiving image sheet with the color forming agent (B), the amount of the color forming auxiliary agent is 50 - 250 parts, preferred with 80 - 120 parts per 100 parts of the color forming agent (B) though it varies a little in accordance with a material of the color forming agent.

A suitable binder is used to adhere a color forming agent (B) and a color forming auxiliary agent on the surface of a receiving image sheet of a photosensitive member or electrostatic recording paper used for this invention.

Representative binders include acetylized starch, styrene-butadiene latex, polyvinyl pyrrolidone, acryl latex, polyvinyl alcohol, soy albumin, casein, oxyethylized starch or these mixture. Further, antioxidant, emulsifier, antiforming agent, ultra violet ray absorber, and the like may be used with a binder, but phenol series antioxidants are not preferable because of being danger of color forming reaction with a color forming main agent. The ultra violet ray absorber, for example, Tinubin, Ps, P320, P326, P327, P328 (trade mark, supplied by Geigy Co.) and the like, can prevent coloring of paper by adding to a receiving image sheet. A paper sheet or web is usually used as a receiving image surface in electrostatic image method. The paper may be comprised of organic and or inorganic fibres such as cellulose, modified cellulose, polymerized cellulose, glass or asbestofibre.

A color forming agent (B) is added to paper at a free step of preparation of paper. The amount of a color forming agent (B) of 0.5 - 1.5 g., preferably 0.7 - 1.0 g. per 1 $m^2$ of the coating surface is useful for color forming reaction with a toner containing a color forming agent (A).

When a color forming agent (B) has been combined into paper in beating step before forming of sheet or is combined into paper after forming of web, a comparatively large amount of a color forming agent (B) is necessary for maintaining sufficiently large amount of a color forming agent (B) on a surface of a paper sheet, and about 1.0 - 2.0 g. of a color forming agent (B) per 1 $m^2$ of the image surface gives a good result.

The relation between an amount of coating per 1 $m^2$ and an image density is different in accordance with a toner.

The image density was measured by effecting a color forming reaction at 180° C between the toner of phenol formaldehyde resin (Trade Mark RB-100 manufactured by Mitsui Toatsu Co.) and the receiving image sheet of Example 1.

The relation between a coated amount and an image density is illustrated at Table 1.

Table 1

| Coated amount of Crystal Violet Lactone | Image Density |
|---|---|
| 0.2 g./m.$^2$ | 0.6 |
| 0.4 | 0.8 |
| 0.6 | 1.0 |
| 0.8 | 1.0 |
| 1.0 | 1.0 |
| 1.2 | 1.0 |

Figure 2:
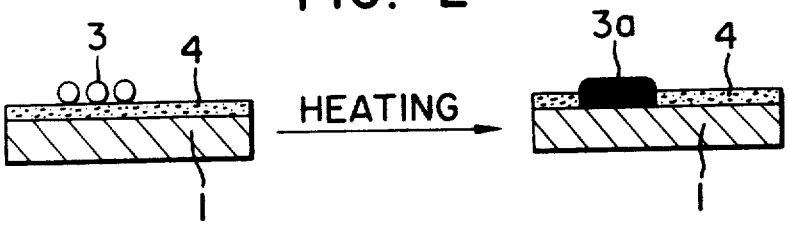
FIG. 2 shows diagrammatically a color forming and fixing procedure according to the present invention.

Now referring to FIG. 1 and FIG. 2 by the example of dry developing method, there is explained the difference between coloring and fixation of the present invention and fixation of conventional electrophotographic method. According to conventional method, a toner image 2 formed on a support 1 such as paper is already covered before heat-fixation and can be fixed to support 1 by heat-fixing at relatively high temperature. On the contrary, according to the color forming fixing method of the present invention, a color forming agent layer 4 is formed on a support 1 such as paper and a toner image 3 containing a color forming agent (A) formed on the color forming agent layer 4 is colorless or of light color. When these are heated at a relatively low temperature and melted to cause a color forming reaction with a color forming agent (B) layer 4 resulting in the colored portion 3*a*. As is clear from above, a conventional toner image is often removed by rubbing while a colored image according to the present invention is not removed at all by rubbing.

Figure 3:
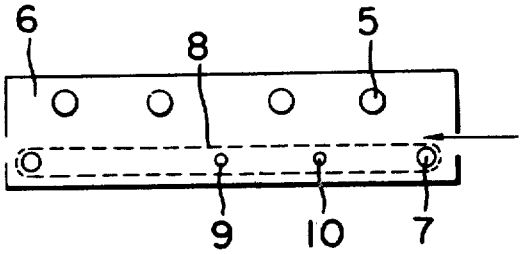
FIG. 3 shows a fixing apparatus.

Conventional dry toner (thermoplastic resin - carbon system) is compared with the toner of the present invention (Example 1) with respect to fixing temperature by using a fixing apparatus as illustrated in FIG. 3.

As shown in FIG. 3, four 250W infrared heaters 5 are arranged and a conveyor 8 of 200 mm long moves at 123 mm/sec. and a transferring sheet moves thereon to form color and fix. Reference numbers 6, 7, 8, 9 and 10 denote a heat insulating material, a gear, a wire net conveyor, a thermometer and a variable thermostat, respectively.

By using this fixing apparatus, each fixing temperature was measured.

| | Fixing temperature (in the apparatus) |
|---|---|
| Toner of the present invention | 180° C |
| Conventional toner | 280° C |

This result indicates that waiting time of a copier can be shortened to a great extent.

The following experimental examples are given for illustrating the improvement accomplished by the present invention. In the experimental examples, ingredients are mixed at the weight ratio as listed in the following tables and melted and cooled, and then pulverized by using a jet mill to form a toner of less than 20 microns in size. Ten parts by weight of the resulting toner was mixed with 90 parts by weight of iron powder of 50 microns in size, and image formation was effected by using NP 1100 Electrophotographic apparatus (manufactured by Canon Co.) and the resulting image was evaluated. A receiving image sheet used was the same as that of Example 1.

The evaluation of each experimental example is conducted as shown below.

1. Pulverizing property:
   ◎ good
   ○ fairly good
   Δ somewhat bad
   X bad
2. Maximum color forming density,
   Fog density:
   Reflective density is measured by MACBETH quantalog densitometer RD-100 with a red filter.
3. Chargeability:
   Mixing an iron powder carrier with a sample toner and measuring polarity of charge, negative or positive.
4. Fixing temperature:
   Measured by a method as mentioned above.

Table 2

| Experiment No. | Polystyrene | Phenol * Compounds | Stearic Acid | Pulverizing property | Chargeability | Maximum Color Forming Density | Fog Density | Fixing Temperature |
|---|---|---|---|---|---|---|---|---|
| 1 | 70 parts | 20 parts | 0 parts | ◎ | − − | 0.5 | 0.01 | 230° C |
| 2 | " | " | 5 | ◎ | − − | 1.2 | 0.01 | 170 |
| 3 | " | " | 10 | ○ | − | 1.2 | 0.015 | 160 |
| 4 | " | " | 20 | ○ | + − | 0.9 | 0.04 | 150 |
| 5 | " | " | 30 | Δ | + − | 0.7 | 0.04 | 150 |
| 6 | " | " | 40 | Δ | + − | 0.7 | 0.04 | 140 |
| 7 | " | 5 | 15 | ◎ | − − | 0.7 | 0.01 | 150 |
| 8 | " | 10 | " | ◎ | − − | 0.7 | 0.01 | 150 |
| 9 | " | 20 | " | ○ | − | 0.9 | 0.03 | 160 |
| 10 | " | 30 | " | ◎ | − | 1.2 | 0.03 | 200 |
| 11 | " | 40 | " | ◎ | + − | 1.2 | 0.04 | 220 |
| 12 | " | 60 | " | ◎ | + − | 1.2 | 0.04 | 220 |

* The phenol compound is 4,4'-isopropylidenediphenyl.

The results of the experiments using myristic acid, aluminium stearate, lead caprylate, glycerol stearate, glycol stearate, methyl behenate, lauric acid amide, lauric acid anilide, lauric acid dodecyl amide and the like in place of stearic acid in the above mentioned experiment were almost the same.

The above results indicate that increase in addition amount of a charge controlling resin (styrene polymer and the like) to a color forming auxiliary agent results in lowering of color forming efficiency and low temperature fixing efficiency so that any satisfactory image can not be obtained. As the added amount of a color forming auxiliary agent increases to the charge controlling resin, the controlling effect is lowered and blur is formed at detailed portion of image and image quality is lowered though low temperature fixation proceeds further.

As the added amount of a color forming agent (A) increase to a charge controlling resin, the controlling effect is lowered in a manner similar to a color forming auxiliary agent and the color forming efficiency is not increase so much.

The experiment on the action and effect of the color forming auxiliary agent on a surface of a receiving image sheet in this invention is given.

The effects such as fixing temperature and color forming density on each ratio of Crystal Violet Lactone as a color forming agent (B) and stearic acid as a fatty acid were measured. The results were illustrated in Table 3.

This results is almost similar to other color forming agents (B) and other color forming auxiliary agents.

When a fatty acid such as stearic acid is a little, the color forming and fixing temperature is high. On the contrary, when the ratio of stearic acid increases, stearic acid remarkably penetrates into an image receiving sheet upon melting of stearic acid and the paper becomes transparent. Serious drawback caused by increased amount of stearic acid is that the color forming density is low. The optimum point where low temperature fixation is possible and no transparency occurs and further the color forming density is high is at a ratio of a color forming auxiliary agent to a color forming agent (B) being 25 – 130 parts, preferably, 40 – 60 parts per 50 parts.

Table 3

| Crystal Violet Lactone (Color forming agent (B)) | Stearic Acid (Color forming auxiliary agent) | 10% Polyvinyl alcohol solution | Fixing Temperature | Maximum Image Density | Note |
|---|---|---|---|---|---|
| 20 parts | 0 parts | 150 parts | 230° C | 0.5 | low $D_{max}$ * |
| " | 5 | " | 190 | 0.9 | " |
| " | 10 | " | 170 | 1.2 | good |
| " | 20 | " | 150 | " | " |
| " | 30 | " | 140 | " | " |
| " | 40 | " | 120 | 1.3 | Semitransparent receiving image sheet |
| " | 50 | " | 100 | " | " |
| " | 60 | " | 90 | " | transparent receiving image sheet |
| " | 70 | " | 70 | " | " |

* $D_{max}$ is maximum image density.

The data of Table 3 were values measured by using the receiving image sheet prepared by coating 2 – 3 microns of thickness of the aqueous solution of a color forming agent (B), a color forming auxiliary agent, polyvinyl alcohol and sodium salt of resin and the same toner as that of Example 1. Fixing temperature and maximum image density were measured by the same method as the above mentioned experiment.

In this invention, the toner used in case of developing by liquid developing method is comprised of a color forming agent (A), a color forming auxiliary agent, charge controlling resin and the like, and the preferable agents, and rosin are as follows.

As color forming agents (A), phenol compounds having low molecular weight such as 4–4'-isopropylidene diphenyl, 4–4'-bis(hydroxyphenyl) butyric acid, 4–4'-bis(4-hydroxylphenyl) pentanic acid and the like are preferable. As charge controlling resins, polystyrene, styrene-acrylonitrile copolymer (styrene : acrylonitrile = 6 : 4), styrene-acrylester (methyl, ethyl, butyl ester etc.) copolymer (styrene : acrylester = 4–9 : 6–1), styrene-acrylonitrile-indene copolymer (styrene : acrylonitrile : indene = 5 : 3 : 2) and the like are preferable, and in particular, a negative toner is obtained easily by using polystyrene and a positive toner is obtained easily by using polyethylene phthalate, epoxy resin or polyamide resin. Then charge controllability may be controlled by using the dyestuffs mentioned in Japanese Patent Publication No. 26478/1970. Furthermore, it is preferable to use polymers of color forming agent (A) together. Of course, polymers of color forming agent (A) may be used alone.

Defects in using the above mentioned polymers are a comparatively low color forming density, and colorizing stronger than phenol compounds having low molecular weight and the like, and the advantages are improvement in light resistance (when the above mentioned polymers are not used, color of a toner fades after exposing for about one week to a direct ray of the sun, but when used, an image remains even after exposing for one month under the same condition as the above case), easy preparation of toner for the wet system, good stability of particles, and easy fixation at room temperature.

As preparation methods for liquid developer, there are a method diffusing fine particles obtained by a dry system, a method of dispersing a resin solution in a solvent into a non-solvent i.e., insulating carrier.

In the former method, the raw materials of a tone: are melted, mixed and ground to obtain particles of 0.5 – 1 micron of particle size. The particles thus obtained are dispersed into an insulating carrier (e.g., Isopar H: manufactured by Esso Standard Oil Co.) with an anionic dispersing agent. In the latter method, the raw materials are roughly dispersed into a non-solvent after dissolving in a solvent, and then are dispersed finely by a colloid mill ore ball mill to form a developer.

An example of a printing process using an electrophotographic method of the present invention is explained below.

There may be used, as a printing master sheet, a developed image which is obtained by developing an electrostatic latent image on an electrophotographic photosensitive member with a toner containing a color forming agent (A) of the present invention. Further, an image obtained by transferring to a transferring member may be also used as a printing master sheet. The master sheet is contacted with an image receiving sheet containing a color forming agent (B) and heated to cause a thermal color forming reaction of a color forming agent (A) with a color forming agent (B) resulting in a visible image. This process can be repeatedly conducted by using a new image receiving sheet to produce many sheets of reproduction.

Figure 4:
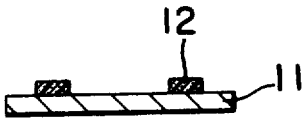
FIG. 4 shows diagrammatically a cross sectional view of a master sheet according to the present invention.

Referring to the drawing, the above process is explained further in detail. A master sheet is prepared by forming an image containing a color forming agent (A) on a surface of a support such as paper, film, electrophotographic photosensitive plate and the like. Referring to FIG. 4, there is illustrated an embodiment of a master sheet. A toner image 12 containing a color forming agent (A) is formed on a paper, film or electrophotographic photosensitive plate 11.

Figure 5:
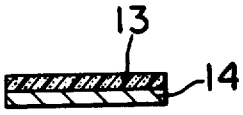
FIG. 5 shows diagrammatically a cross sectional view of a printing member used in the present invention.

Referring to FIG. 5, there is shown a printing member in which a color forming agent (B) layer 13 is provided on an appropriate support 14 such as paper, cloth, film and the like.

Figure 6:
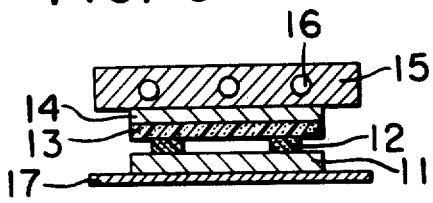
FIG. 6 shows diagrammatically a procedure for reproducing an image by using a master sheet of FIG. 4 and a printing member of FIG. 5.
Figure 7:
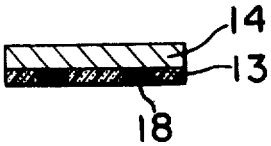
FIG. 7 shows diagrammatically a reproduction obtained in FIG. 6.

Referring to FIG. 6, the master sheet in FIG. 4 and the printing member in FIG. 5 are used for reproduction. A master sheet 11, 12 is placed on a plate 17 and a printing member 13, 14 is placed on the master sheet by facing the color forming agent (B) layer to the toner image of the master sheet. A box 15 composed of glass or a thermally conductive material provided with a heater 16 such as infrared ray heater, nichrome wire heater and the like is pressed to the printing member. Thus, a thermal reaction is caused to produce color forming images 18 as shown in FIG. 7. In other words, a part of image containing a color forming agent (A) is absorbed into a layer containing a color forming agent (B) of the printing member, transferred thereto and a color forming reaction occurs to form a colored image by pressing and heating. Further, many reproduction can be obtained by repeating the above-mentioned procedure.

Images containing a color forming agent (A) may be produced by various methods. For example, an image is written by hand using an ink containing a color forming agent (A). An image can be formed by an electrophotographic process. A photoconductive photosensitive member, e.g., photoconductive zinc oxide paper, is charged and exposed by a known method, and then subjected to dry development by a magnetic brush method of cascade developing method using a toner containing a color forming agent (A) or wet development by a liquid developer composed of toner containing a color forming agent (A) dispersed in an isoparaffin high insulating liquid. The resulting toner images produced on the zinc oxide paper is used as a master sheet. The light image as used in the above procedure for exposure is a mirror image with respect to the original image.

A photoconductive layer of a photoconductive selenium photosensitive drum or a photoconductive zinc oxide photosensitive drum is charged and exposed by a known method and developed with dry developer by a known magnetic brush or cascade developing method. The resulting toner image can be used as a master sheet, or the toner image transferred to an other sheet may be used as a master sheet.

A photoconductive selenium photosensitive plate or photoconductive zinc oxide layer is charged, exposed by a known method, and developed with a toner containing a color forming agent (A) dispersed in an isoparaffine high insulating carrier, and the image thus developed or the developed image further transferred to an other sheet can be used as a master sheet.

A selective discharging is applied to a photoconductive layer, such as selenium layer, having an insulating film, and a dry or liquid developer containing a color forming agent (A) is used for development. The resulting toner image can be used as a master sheet.

According to the above printing methods, it is possible to produce many sheets of multicolor printing. In a recording method using a thermal color forming reaction of a color forming agent (A) with a color forming agent (B), a plurality of master sheets corresponding to spectrally divided color which has a toner image containing a color forming agent (A) capable of producing a color corresponding to each spectral color. These master sheets are sequentially pressed to a printing member having a color forming agent (B) containing surface and heated by heating at least one of the master sheet and the printing member.

An example of color heat sensitive printing method is as shown below. Master sheets are prepared by an electrophotographic means. In usual, three master sheets i.e., red, blue and green master sheets, corresponding to three divided visible spectra, are prepared.

First photoconductive photosensitive layer sheet after charged is exposed to a light image through a red filter and developed with a color forming agent (A) capable of giving cyan color. Second photoconductive photosensitive layer sheet after charging is exposed to a light image through a green filter and developed with a color forming agent (A) capable of giving magenta color. Third photoconductive photosensitive layer sheet after charging is exposed to a light image through a blue filter and developed with a color forming agent (A) capable of giving yellow color. The resulting three sheets are used as master sheets. Then, these three master sheets are sequentially pressed to a printing paper containing a color forming agent (B) and heated by using an apparatus as shown in FIG. 6. According to the above mentioned method, fusing color forming is effected by heating so that a mixed color can be obtained since the later formed color does not suppress the former formed color.

According to the above mentioned method, a complicated and expensive printing machine is not necessary, and many sheets of reproduction can be easily and quickly obtained.

The resulting printing matter is of high density and good quality.

A color forming agent (A) and a color forming agent (B) are usually separated from each other so that the printed matter is stable against light and heat as compared with conventional heat sensitive reproduction.

The following examples are given for illustrating the present invention, but should not be construed as limiting the present invention.

The parts in the following examples are by weight unless otherwise indicated.

EXAMPLE 1

Twenty parts of 4,4'-isopropylidene diphenyl, 15 parts of myristic acid and 70 parts of polystyrene were mixed, melted, cooled and ground by a jet mill grinder into a particle size of 5 - 20 microns to produce a toner.

One part of the obtained fine powdered toner was mixed with 3 - 30 parts, preferably 5 - 10 parts, of iron powder (i.e., a carrier). (The particle size of a carrier was 20 - 75 microns, preferably 25 - 50 microns.)

A carrier was charged positively and a toner was charged negatively in the developing agent obtained from the toner and the carrier.

Then a toner image was formed by developing the electro latent image on a insulating layer obtained by the electrographic method disclosed in Japanese Patent Publication No. 23910/1967 by the magnet brush method with the above mentioned developing agent.

Twenty parts of Crystal Violet Lactone, 180 parts of 10% aqueous solution of polyvinyl alcohol and 0.5 parts of emulsifier (trade name: Dresinate X) were mixed and ground by a ball mill for 24 hours, to which 50 parts of water was added to obtain a coating solution. A paper was coated with the coated solution in an amount of 7 g./m$^2$. to obtain a transferring paper. The toner image was transferred to the transferring apper and heated at 180° to form blue color in the portion where the powder image was transferred. The resultant copy was clear. The resultant image did not vanish even when rubber strongly with an eraser.

The transferring paper were produced by using (1) Rhodamine Lactone, (2) Malachite Green Lactone and (3) 8'-methoxyindolinospiropyran in place of Crystal Violet Lactone. The toner image developed with the same toner was transferred to three kinds of transferring paper. Three transferred images were each heated to obtain a red copy on (1), a green copy on (2) and a black copy on (3).

EXAMPLE 2

Twenty parts of 2,2'-dihydroxydiphenyl, 15 parts of lead capronate and 70 parts of polystyrene were mixed, melted, cooled and ground by a jet mill into a particle size of 5 - 20 microns to obtain a toner.

One part of the obtained fine powdered toner was mixed with 3 - 30 parts, preferably 5 - 10 parts of iron powder (i.e., a carrier).

Then a toner image was formed by developing the electrostatic latent image on an insulating layer obtained by the electrographic method mentioned in Japanese Patent Publication No. 23910/1967 by the magnet brushing method by using the above mentioned developing agent.

Then, 20 parts of Malachite Green Lactone, and 40 parts of stearic acid were mixed and melted by heating, were added to 150 parts of 10% aqueous solution of polyvinyl alcohol at 80° C, were dispersed by adding emulsifier (trade name: Dresinate X), to which 40 parts of water was added and cooled to prepare the coating solution. The coating solution was coated on a paper in the amount of about 7 g./m.$^2$ and was dried to obtain a transferring paper.

The above mentioned toner image was transferred to the transferring paper and heated at about 180° C, and the portion where the toner image was transferred formed green color to obtain a clear copy. The resultant image did not vanish even when rubbed strongly with an eraser.

EXAMPLE 3

Twenty parts of phenolic resin, 15 parts of palmitic acid phenyl and 70 parts of polystyrene were mixed, melted, cooled and ground by a jet mill grinder into a particle size of 5-20 microns to obtain a toner.

One part of the obtained fine powdered toner was mixed with 3-30 parts, preferably 5 - 10 parts, of iron powder (i.e., a carrier).

Then a powder image was formed by developing the electrostatic latent image on an insulating layer obtained by the electrographic method disclosed in Japanese Patent Publication No. 23910/1967 by the magnetic brush method by using the above mentioned developing agent.

Twenty parts of phadamine leuco Lactone and 40 parts of ethylene glycol dibenzoate were heated to melt, added to 150 parts of 10% aqueous solution of polyvinyl alcohol at 80° C, dispersed by adding emulsifier (trade name: Dresinate X), to which 40 parts of water was added, and cooled to obtain the coating solution. The coating solution was coated on a paper in the amount of about 7 g./m.$^2$ and was dried to obtain a transferring paper.

The above mentioned toner image was transferred to the transferring paper and was heated at about 180° C to form green color in the portion where the powder image was transferred. The resultant copy was clear. The resultant image did not vanish when rubbed strongly with an eraser.

EXAMPLE 4

Twenty parts of p-cresol, 15 parts of lauric acid amide and 70 parts of polyester resin were mixed, melted, cooled and ground by a jet mill grinder into a particle size of 5 - 20 microns to obtain a toner.

Then 1.0 part of acrylic resin, 4.0 parts of zinc oxide, 2 parts of 8'-methoxybenzoindolinospiropyran and a mixed solvent of xylene and toluene (50 : 50) were mixed in a ball mill for 24 hours, to which the above mentioned solvent was added to obtain the coating solution having viscosity of 80 - 110 c.p. The photosensitive paper comprised of ZnO-acrylic resin binder was coated with the coating solution uniformly charged with a corona discharger, and then, exposed to a light pattern to form an electrostatic latent image, which was developed by the above mentioned toner. The obtained toner image was heated at a temperature of about 180° C to form black color in the portion of the powder image. The resultant copy was clear.

EXAMPLE 5

Twenty parts of 4-ter-butyl phenol, 15 parts of stearic acid anilide and 70 parts of polystyrene were mixed, melted, cooled and then ground by a jet mill grinder into a particle size of 5 - 20 microns to obtain a toner.

One part of the fine powdered toner was mixed with 3 - 30 parts, preferably 5 - 10 parts, of iron powder (i.e., a carrier).

The electrostatic latent image obtained on an insulating layer by the electrographic method disclosed in Japanese Patent Publication No. 23910/1967 was developed with the above mentioned developing agent obtained above by means of magnetic brush technique to form a toner image.

Forty parts of styrene-maleic acid copolymer, 200 parts of methanol and 20 parts of 3',6'-diaminospiro(phthalan-1,9'-xanthene) were mixed and ground in a ball mill, to which 300 parts of methyl ethyl ketone was added to obtain fine particles coated with 3',6'-diaminospiro(phthalan-1,9'-xanthene) resin. The fine particles was classified and mixed with 150 parts of a 10% aqueous solution of polyvinyl pyrrolidone and 40 parts of water to obtain a coating solution. A paper was coated with the coating solution to obtain a transferring paper.

The above mentioned powder image was transferred on the transferring paper and heated at about 200° C to form black color in the portion where the powder image was transferred. The resultant copy was clear.

EXAMPLE 6

Twenty parts of 4-hydroxyacetophenol, 15 parts of lauric acid and 70 parts of polystyrene were mixed, melted, cooled and ground by a jet mill grinder into a particle size of 5 - 20 microns to obtain a toner.

One part of the toner and 3 - 30 parts, preferably 5 - 10 parts, of iron powder (i.e., a carrier) were mixed.

The electrostatic latent image produced on an insulating layer by the electrographic method disclosed in Japanese Patent Publication No. 23910/1967 was developed with the above mentioned developing agent produced above by means of magnetic brush technique to form a toner image.

Twenty parts of Crystal Violet Lactone and 40 parts of lead stearate were heated to melt, and added to 150 parts of 10% aqueous solution of polyvinyl alcohol heated at 80° C and 0.5 parts of emulsifier (trade name: Dresinate X), to which 40 parts of water was added and cooled to obtain a coating solution. A paper was coated with the coating solution in the amount of about 7 g./m.$^2$ and dried to obtain a transferring paper.

The above mentioned powder image was transferred to the transferring paper and heated at about 180° C to form blue color in the portion where the powder image was transferred. The resultant copy was clear. The resultant image did not vanish even when rubbed strongly with an eraser.

EXAMPLE 7

Twenty parts of hydrolysis product of carboxypolyethylene polymer, 15 parts of palmitic acid methylamide and 70 parts of polystyrene were mixed, melted, cooled and then ground by a jet mill grinder into a particle size of 5 - 20 microns to obtain a toner.

One part of the toner and 3 - 30 parts; preferably 5 - 10 parts, of iron powder were mixed.

The electrostatic latent image obtained on an insulating layer by the electrographic method disclosed in Japanese Patent Publication No. 23910/1967 was developed with the above mentioned developing agent obtained above by means of the magnetic brush method to form a toner image.

Twenty parts of 1,1-bis(p-aminophenyl)phthalan and 40 parts of stearic acid dodecylamide were heated to melt, and added to 150 parts of 10% aqueous solution of polyvinyl alcohol heated at 80° C, to which 0.5 parts of emulsifier (trade name: Dresinate X) was added and thereafter 40 parts of water was added to the coating solution. After the coating solution was cooled, a paper was coated with the coating solution in the amount of about 7 g./m.$^2$ and dried to obtain a transferring paper.

The above mentioned toner image was transferred to the transferring paper and heated at about 180° C to form violet color in the portion where the toner image was transferred. The resultant copy was clear. The resultant image did not vanish even when rubbed strongly with an eraser.

EXAMPLE 8

The following materials (1) - (6) were used in place of hydrolysis product of carboxypolyethylene polymer, and the other procedures were the same as that of Example 7, and the result was the same as that of Example 7.

1. Phenol acetylene polymer
2. Phenol aldehyde polymer
3. Hydrolysis product of vinyl methyl ether - maleic acid anhydride copolymer
4. Hydrolysis product of ethylene - maleic acid anhydride copolymer
5. Hydrolysis product of styrene - maleic acid anhydride copolymer
6. Rosin-modified maleic acid polymer

EXAMPLE 9

Twenty parts of α-naphthol, 15 parts of laurio acid methylamide and 70 parts of polystyrene were mixed, melted, cooled and then ground by a jet mill grinder into a particle size of 5 - 20 microns to obtain a toner.

One part of the toner and 3 - 30 parts, preferably 5 - 10 parts, of iron powder (i.e., a carrier) were mixed.

The electrostatic latent image produced on an insulating layer by the electrographic method disclosed in Japanese Patent Publication No. 23910/1967 was developed with the above mentioned developing agent produced above by means of magnet brush technique to form a toner image.

Nine parts of Crystal Violet Lactone, 3 parts of Rhodamine Lactone, 3 parts of Malachite Green Lactone, 9 parts of leuco auramine and 40 parts of stearic acid were heated to melt, and added to 150 parts of 10% aqueous solution of polyvinyl alcohol heated at 80° C, to which 0.5 parts of emulsifier (trade mark: Dresinate X) was added and thereafter 40 parts of water was added to obtain the coating solution. After the coating solution was cooled, a paper was coated with the coating solution in the amount of about 7 g./m.$^2$ to obtain a transferring paper.

The above mentioned toner image was transferred to the transferring paper and heated at about 180° C to form black color in the portion where the toner image was transferred. The resultant copy was clear. The resultant image did not vanish even when rubbed strongly with an eraser.

EXAMPLE 10

Twenty parts of 4,4'-cyclohexylidene bis(2-methyl phenol), 15 parts of stearic acid amide and 70 parts of styrene - acrylic acid methyl ester copolymer (copolymerization molar ratio 6 : 4)were mixed and ground by a vibrating grinder. The mixture was sufficiently fused and cooled to solidify.

The solidified material was crushed by a hammer mill crusher and ground by a jet mill grinder into the particle size of 1 - 50 microns, preferably 5 - 20 microns. One part of the fine powder (i.e., a toner), and 3 - 30 parts, preferably 5 - 10 parts, of iron powder (i.e. a carrier), were mixed.

The particle size of the carrier was 20 - 75 microns, preferably 25 - 50 microns. The carrier was charged negatively in the mixture of the carrier and the toner (i.e., the developing agent).

The photoconductive layer composed of a vapor-deposited selenium on an aluminum sheet was uniformly charged with a corona discharger, and then exposed to a light pattern to form an electrostatic latent image, which was developed by the above mentioned toner to form a toner image.

Twenty parts of Malachite Green Lactone and 40 parts of aluminum stearate were heated to melt and added to 150 parts of 10% aqueous solution of polyvinyl alcohol heated at 80° C, to which 0.5 parts of emulsifier (trade mark: Dresinate X) was added and thereafter 40 parts of water was added to obtain a coating solution. After the coating solution was cooled, a paper was coated with the coating solution in the amount of about 7 g./m.$^2$ and dried to obtain the transferring paper.

The above mentioned powder image was transferred to the transferring paper and heated at about 180° C to form green color in the portion where the powder image was transferred. The resultant copy was clear. The resultant image did not vanish even when rubbed strongly with an eraser.

EXAMPLE 11

Following Example 1 except that N-(2,5-dichlorophenyl) leuco auramine, N-acetyl auramine and dianisylidene acetone were used in place of Crystal Violet Lactone, the result was the same as that of Example 1.

EXAMPLE 12

One part of an antioxidant (trade name: Irganox 565)and 1 part of an ultraviolet absorber (trade name: Tinuvin 328) were added to the coating solution used for the transferring paper of Example 1, and the other procedures were the same as those of Example 1. The resultant copy was clear blue. The copy was better in light resistance and had less fog than that of Example 1.

The working examples of production of dry and liquid developing agents used for this invention and forming color image by using the above mentioned developing agent are illustrated below.

EXAMPLE 13

Sixty grams of 4,4'-isopropylidene diphenyl, 272 g. of polystyrene (trade name: Piccolastic D-125 manufactured by Esso Co.), 31 g. of phenol resin (trade name: RB-100 manufactured by Mitsui Toatsu Co.), 18 g. of stearic acid and 17 g. of Aerosil (trade name: #200 manufactured by DEGUSSA) were mixed and ground by a ball mill for 24 - 30 hours. The mixture was sufficiently melted, mixed, cooled, crushed by a hammer mill (particle size: about 1 mm.) and then ground by an air jet type grinder. (Grinding pressure 6 - 7 kg./cm.$^2$; supplying amount 310 kg./H.). The fine powders were sieved by an air shifter and particles of 5 - 20 microns, and particles of less than 1.0 micron were selected to obtain. a toner. The toner of the particle size of 5 - 20 microns mixed with iron powder (the particle size of 20 - 40 microns) in the ratio of 15 : 85 to obtain a developing agent for magnet brush developer. Five grams of the toner of the particle size of less than 1.0 micron was added to 1*l* of Isopar H containing 0.015 g. of Pelex NB and dispersed with attritor to obtain a liquid developing agent.

The following composites (Examples 14 - 19) were treated by the procedures of Example 13 to produce a dry developing agent or a liquid developing agent.

EXAMPLE 14

| | |
|---|---|
| **4,4'-Bis (hydroxyphenyl) butyric acid** | 60 g. |
| Polystyrene | 270 g. |
| Phenolic resin | 34 g. |
| Behenic acid | 16 g. |
| Aerosil | 17 g. |

EXAMPLE 15

| | |
|---|---|
| **4,4'-Bis (4-hydroxylphenyl)** pentanoic acid | 60 g. |
| Styrene-acrylonitrile-indene copolymer (trade name: Piccoflex 520 manufactured by Esso Co.) | 268 g. |
| Phenolic resin | 32 g. |
| Myristic acid | 18 g. |
| Aerosil | 18 g. |

EXAMPLE 16

| | |
|---|---|
| 4-Phenylphenol | 60 g. |
| Polystyrene | 270 g. |
| Phenol aldehyde copolymer resin | 32 g. |
| Beryllium stearate | 18 g. |
| Aerosil | 17 g. |

EXAMPLE 17

| | |
|---|---|
| 4-Hydroxydiphenyl oxide | 60 g. |
| Styrene-acrylic acid ethyl ester copolymer | 272 g. |
| Phenolic resin | 33 g. |
| Palmitic acid | 17 g. |
| Aerosil | 18 g. |

EXAMPLE 18

| | |
|---|---|
| 4-Hydroxyacetophenol | 60 g. |
| Styrene-acrylonitrile copolymer | 273 g. |
| Styrene-maleic acid anhydride copolymer | 34 g. |
| Propionic acid amide | 18 g. |
| Aerosil | 18 g. |

EXAMPLE 19

| | |
|---|---|
| 4-Ter-butylphenol | 60 g. |
| Styrene-butadiene copolymer resin | 274 g. |
| Rosin modified maleic acid resin | 32 g. |
| Enanthic acid amide | 18 g. |
| Aerosil | 18 g. |

EXAMPLE 20

Sixty grams of 4,4'-isopropylidene diphenyl, 270 g. of polystyrene, 32 g. of phenolic resin, 18 g. of lacceric acid and 18 g. of Aerosil were dissolved and dispersed in 3 *l* of MEK, which was dispersed in 15 *l* of Isopar H (containing Pelex NB) and furthermore dispersed finely by attritor disperser for 30 - 40 min. Isoper H was added to the fine dispersed solution to obtain the dispersed solution containing 5% (solid matter). The resultant dispersed solution was used as a developing solution.

EXAMPLE 21

Sixty grams of 4,4'-bis (hydroxyphenyl) butyric acid, 270 g. of styrene-acrylonitrile copolymer, 33 g. of phenolic resin, 18 g. of stearic acid glycol and 18 g. of Aerosil were dissolved in 1 *l* of acetone and 2.5 *l* of MEK, and dispersed in 5 *l* of Isopar H. The dispersed materials were filtered under reduced pressure and were dispersed in 10 *l* of Isopar H again and then dispersed finely by attritor. The solution was diluted with Isopar H to 5% of solid content. The resultant solution was used as a developing solution.

EXAMPLE 22

The same composites as that of Examples 15 - 19 were treated by the same procedures as those of Example 21 to obtain the developing solution.

EXAMPLE 23

Sixty grams of 4,4'-isopropylidene diphenyl, 270 g. of polyethylene phthalate resin, 33 g. of phenolic resin, 18 g. of stearic acid and 18 g. of Aerosil were treated by the same procedures as those of Example 21, and the positive type developing solution was obtained.

EXAMPLE 24

Sixty grams of 4,4'-bis (hydroxylphenyl) butyric acid, 273 g. of epoxy resin, 32 g. of phenolic resin, 18 g. of behenic acid ethyl and 18 g. of Aerosil were treated by the same procedures as those of Example 21, and the positive type developing solution was obtained.

EXAMPLE 25

Sixty grams of 4,4'-isopropylidene diphenyl, 270 g. of polyamide resin, 32 g. of phenol resin, 18 g. of melissic acid methyl and 18 g. of Aerosil were treated by the same procedure as those of Example 21, and the positive developing solution was obtained.

The examples using dry and liquid developing agents are illustrated.

EXAMPLE 26

Ten parts of Crystal Violet Lactone, 2 parts of polystyrene, 40 parts of dimethyl formamide, 1 part of stearic acid and 1 part of diethyl diphenyl were mixed and dispersed by a ball mill for 24 hours. A commercial zinc oxide photosensitive paper was coated with the above mentioned solution by the air-knife method in the amount of the solution containing 0.4 g. of Crystal Violet Lactone. The photosensitive paper was subjected to corona charging at 7 KV with corona discharger in a dark place and imagewise exposed and then was developed with the developing solutions used in Examples 13 – 25 and heated to fix. All of the obtained images were blue color.

EXAMPLE 27

The color forming agents (B) illustrated at the following table were used in place of Crystal Violet Lactone, and the other procedures were the same as those of Example 26. The resultant color images were as shown at following Table.

| Forming color agent | Forming color image |
|---|---|
| Rhodamine B Lactone | Red |
| 1-1-bis(p-aminophenol)phthalan | Violet |
| Malachite Green Lactone | Green |
| 6-6'-diaminospiro(phthalan-1,9-xanthene) | Red |
| 8'-Methoxyindolinospiropyran | Bluish black |

EXAMPLE 28

Thirty parts of Malachite Green Lactone (MGL) and 200 parts of 2.5% methanol solution of styrene-maleinic acid copolymer were mixed and ground by a ball mill, to which 300 parts of methyl ethyl ketone was added and mixed to obtain fine particles coated with resin of MGL. Thirty parts of 50% styrene-butadiene latex was added to the fine particles to obtain a coated solution. The paper treated with vinyl benzyl quaternary ammonium salt was coated with the coating solution to prepare a color forming sheet.

The CdS photosensitive plate disclosed in Japanese Patent Publication No. 23910/1967 was charged in +400 Volt and the charge was transferred to the above mentioned color forming sheet to charge in +80 – +100 Volt. The color forming sheet was developed with the developing solution of Example 15 and heated to fix. The resultant copy was green.

EXAMPLE 29

Five parts of 6'-diethylamino-2'-methylaminofluoran, 10 parts of dimethyl formamide, 10 parts of dimethylsulfoxide (D.M.S.O.) and 1 part of polyvinylbutyral were mixed and dissolved to obtain a coated solution. The electrostatic recording paper treated with polyvinylbutyral was coated with the coated solution in the amount of it containing 0.5 g./m.$^2$ of 6'-diethylamino-2'-methylaminofluoran. The electrostatic recording sheet was charged at +500 Volt by a needle electrode to form image pattern of charge, which was developed with the developing solution of Example 25 and fixed to form black image.

EXAMPLE 30

Ten parts of Crystal Violet Lactone, 100 parts of polyvinyl alcohol (10% aqueous solution), 0.25 parts of emulsifier (trade name: Dresinate X) and 30 parts of stearic acid were mixed and finely dispersed by a ball mill for 24 hours to produce an emulsion. A high grade paper was coated by the emulsion at the speed of 25 m./min., and under air pressure of 500 m.m. Aq. by an air-knife method. The coated paper was dried at 80°–85° C. The paper used was a high grade paper of 52.3 g./m$^2$. The forming color image receiving sheet was coated with the solution containing 0.5 g./m$^2$. of Crystal Violet Lactone.

The electrostatic latent image was formed on a photosensitive member fundamentally composed of an electroconductive base plate, a photoconductive layer, and an insulating layer by the electrographic method disclosed in Japanese Patent Publication No. 24077/1970, that is, the surface of the insulated layer was uniformly charged positively when the photoconductive layer was N type and charged negatively when the photoelective layer was P type, and then was charged with alternating current corona discharger or direct current corona discharger having polarity opposite to that of the above charged. The electrostatic latent image was developed with the developing solutions of Examples 13 — 25 and was transferred to the above mentioned receiving image sheet and was heated at 180° C to form a blue image.

EXAMPLE 31

| | |
|---|---|
| Rhodamine B Lactone | 10 parts |
| Stearic acid dodecyl amide | 20 parts |
| Polyvinylpyrrolidone (10% aqueous solution) | 100 parts |
| Emulsifying dispersing agent (Neopelex-05, trade name) | 0.5 parts |

By using a composition of the above ingredients following the procedure of Example 30, there was obtained an image receiving sheet, and transferring of image was conducted to give red images.

EXAMPLE 32

| | |
|---|---|
| 1,1-Bis(p-aminophenyl)phthalan | 10 parts |
| Aluminum stearate | 20 parts |
| Polyvinylalcohol (10% aqueous solution) | 100 parts |
| Emulsifying dispersing agent (Neopelex-05, trade name) | 1.0 parts |

By using a composition of the above ingredients and following the procedure in Example 30, there was obtained a color forming image receiving sheet having a coating of 0.7 g./m$^2$. A developed image was transferred to the sheet and heated to 180° C to produce a sharp violet image.

EXAMPLE 33

Ten parts of Crystal Violet Lactone was dissolved in 30 parts of diethyl diphenyl and then dispersed in an aqueous solution composed of a 10% aqueous solution of gelatin (250 parts) and an emulsifying dispersing agent (Neopelex-05, trade name) (one part) by using a supersonic dispersing machine. Thus, the oily drops of Crystal Violet Lactone were dispersed to form a particle of less than 0.5 microns. The resulting dispersion was applied to a triacetate film (150 microns in thickness) having a gelatin undercoating and dried at 55° C to obtain a transparent film of 1.0 g./m$^2$. To the resulting film was transferred a developed image and heated at 170° C to produce a transparent blue image.

EXAMPLE 34

Ten parts of Rhodamine B Lactone was dissolved in 28 parts of diethyl diphenyl and then mixed with a solution of 10 parts of styrene-acrylonitrile copolymer in 100 parts of methyl ethyl ketone with stirring. The resulting solution was applied to a polyethylene terephthalate film subjected to a hydrophilizing treatment in a way similar to Example 30 to produce an image receiving sheet having the coating of 1.2 g./m$^2$.

To the image receiving sheet was transferred a developed image and heated at 170° C to produce a transparent red image.

EXAMPLE 35

There were obtained images by developing with a dry developer in Examples 13 - 19 an electrostatic latent image produced by an electrophotographic method as described in Japanese Patent Publication No. 23910/1967, that is, positively charging uniformly a photosensitive member comprising a conductive base plate, a photoconductive material layer (e.g. CdS layer) and an insulating layer such as polyethylene terephthalate, applying charging of a polarity opposite to the primary charge or AC simultaneously with imagewise exposure to produce an electrostatic latent image followed by dry development, transferring the developed image to an image receiving sheet, then cleaning the photosensitive member and using the photosensitive member repeatedly.

| | |
|---|---|
| Crystal Violet Lactone | 2 g. |
| Silicon resin (KR-211, trade name, supplied by Shinetsu Kagaku) | 5 g. |
| Dimethyl formamide | 40 ml. |

The above-mentioned ingredients are mixed and dissolved and applied to an ethylene terephthalate film (Lumirror, trade name, supplied by Toray) in the thickness of 0.5 microns (when dried) by reverse coating to produce a transparent transferring sheet.

To the resulting transferring sheet was transferred the above-mentioned developed image and heated to produce a sharp and transparent blue copy.

EXAMPLE 36

There were obtained images by developing with a liquid developer in Examples 13 - 25 an electrostatic latent image produced by an electrophotographic method as described in Japanese Patent Publication No. 24077/1970, that is, positively charging uniformly a photosensitive member comprising a conductive base plate, a photoconductive material layer (e.g. CdS layer) and an insulating layer such as polyethylene terephthalate, applying charging of a polarity opposite to the primary charge or AC simultaneously with imagewise exposure to produce an electrostatic latent image followed by wet development, transferring the developed image to an image receiving sheet, then cleaning the photosensitive member and using the photosensitive member repeatedly.

| | |
|---|---|
| Crystal Violet Lactone | 2 g. |
| Silicon resin (KR-211, trade name, supplied by Shinetsu Kagaku) | 5 g. |
| Dimethyl formamide | 40 ml. |

The above-mentioned ingredients are mixed and dissolved and applied to an ethylene terephthalate film (Lumirror, trade name, supplied by Toray) in the thickness of 0.5 microns (when dried) by reverse coating to produce a transparent transferring sheet.

To the resulting transferring sheet was transferred the above-mentioned developed image and heated to produce a sharp and transparent blue copy.

EXAMPLE 37

Following the procedure of Example 36 except that a transferring sheet containing the color forming agent (B) as shown below is used in place of that containing Crystal Violet Lactone, there was obtained a sharp and transparent color copy.

| Color forming agent (B) in a transferring sheet | Color of image |
|---|---|
| Rhodamine B Lactone | Red |
| 1,2-Bis(p-aminophenyl)phthalan | Violet |
| Malachite Green Lactone | Green |
| 6,6'-Diaminospiro(phthalan-1,9'-xanthene) | Red |
| 8'-Methoxyindolinospiropyran | Bluish black |

Some examples using an organic photoconductive material are shown below.

EXAMPLE 38

To a support composed of polyethylene terephthalate film (100 microns in thickness) having a gelatin undercoating was applied a polymer of quaternary ammonium salt (CP-261, trade name, supplied by Calgon Corp.) in an amount of 3 - 6 g./m$^2$. (solid matter) as a conductive layer followed by drying sufficiently. To the surface of the resulting conductive layer was applied a 5% solution of poly-9- vinylcarbazole (sensitized with Crystal Violet) in monochlorobenzene by roll to form a photoconductive film. To the surface of the photoconductive film of 5 - 8 g./m$^2$. thus obtained was applied a color forming agent (B) as shown below. Crystal Violet Lactone (C.V.L.) was dissolved in dimethylformamide to form a 7% solution. 100 Ml. of the resulting solution was mixed with 10 - 15 ml. of a 5% solution of poly-9-vinylcarbazole in monochlorobenzene and was applied to the above-mentioned photoconductive film in an amount of 1.5 - 3.0 g./m$^2$. by roll followed by drying to produce an electrophotographic photosensitive member having an organic photoconductive layer containing the color forming agent (B).

EXAMPLES 39 - 50

Materials listed in Table 4 were used and the procedure of Example 38 was repeated to form organic photoconductive photosensitive members.

Table 4

| Ex. | Support base | Conductive resin | Organic photoconductive material | Color forming main agent |
|---|---|---|---|---|
| 39 | The same as in Example 38 | The same as in Example 38 | Poly-3,6-dibromo-9-vinylcarbazole | Crystal Violet Lactone |
| 40 | " | " | " | " |

Table 4-continued

| Ex. | Support base | Conductive resin | Organic photoconductive material | Color forming main agent |
|---|---|---|---|---|
| 41 | " | Quaternary ammonium salt polymer (ECR-34, trade name, supplied by Dow Chemical) | * 2 | " |
| 42 | Triacetate film having gelatin undercoating (100 microns in thick) | " | Poly-3,6-dinitro-9-vinylcarbazole | " |
| 43 | " | " | Poly-3,6-diiodo-9-vinylcarbazole | " |
| 44 | " | The same as in Example 38 | Poly-3,6-dibromo-9-vinylcarbazole | Malachite Green Lactone |
| 45 | The same as in Example 38 | " | Poly-3,6-dichloro-9-vinylcarbazole | Rhodamine Lactone |
| 46 | " | " | Poly-3,6-dinitro-9-vinylcarbazole | Lenco auramine |
| 47 | " | " | * 1 | Malachite Green Lactone |
| 48 | " | " | * 2 | Rhodamine Lactone |
| 49 | " | " | Poly-9-vinylcarbazole | " |
| 50 | " | " | Poly-3,6-dibromo-9-vinylcarbazole | Lenco auramine |

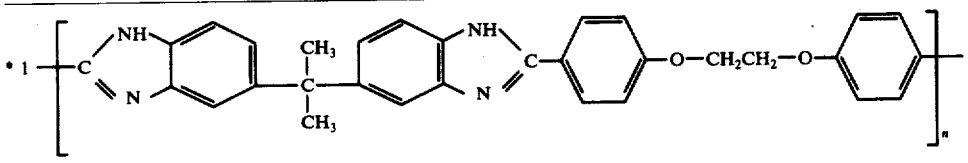

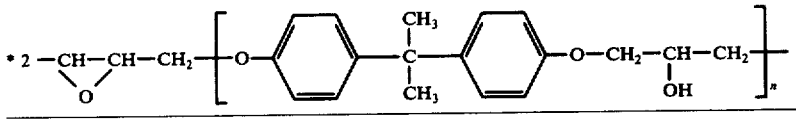

EXAMPLE 51

The organic photoconductive film obtained in Example 38 was subjected to corona charging of −6 KV and imagewise exposure to form an electrostatic latent image.

A liquid developer was prepared by the following procedure.

| | |
|---|---|
| 4,4'-Isopropylidene diphenyl | 60 g. |
| Polystyrene (Piccolastic D-125, trade name, supplied by Esso) | 272 g. |
| Phenolic resin (RB-100, supplied by Mitsui-Toatsu) | 31 g. |
| Methyl arachate | 18 g. |
| Aerosil (#200, trade name, supplied by DEGUSSA) | 17 g. |

A composition of the above mentioned ingredients was mixed and ground for 24 - 30 hours by a ball mill, sufficiently melted and kneaded by a roll mill, cooled, then roughly ground to about 1 mm. in size by a hammer mill and further finely divided by a pulverizer of air-jet pulverization type (pulverizing pressure 6 - 7 Kg./cm². and feed 3 Kg./hour). The resulting finely divided powders were classified by a wind classifier and powder of less than 1.0 micron was employed as a toner. 5.0 grams of the toner was added to an insulating liquid composed of 1 *l* of Isopar H containing 0.015 g. of Pelex NB (trade name, supplied by Kao Co.) followed by dispersing by an attritor to produce a liquid developer.

The resulting developer was used to develop the electrostatic latent image as obtained above and the resulting developed colorless image was heated and melted to form a transparent blue visible image.

EXAMPLE 52

The organic photoconductive film obtained in Example 39 was subjected to corona charging of −6KV and imagewise exposure to form an electrostatic latent image.

A liquid developer was prepared by the following procedure.

| | |
|---|---|
| 4,4'-Bis(hydroxydiphenyl)butyric acid | 60 g. |
| Polystyrene (Piccolastic D-125, trade name) | 270 g. |
| Phenolic resin (RB-100, trade name, supplied by Mitsui-Toatsu) | 34 g. |
| Caproic acid anilide | 16 g. |
| Aerosil | 17 g. |

A liquid developer was obtained by using the above components following the procedure of Example 51.

The electrostatic latent image was developed by the resulting liquid developer to form a colorless image on the organic photoconductive layer and heated and melted to produce a transparent blue visible image.

EXAMPLE 53

The organic photoconductive film obtained in Example 40 was subjected to corona charging of −6KV and imagewise exposure to form an electrostatic latent image.

A liquid developer was prepared by the following procedure.

| | |
|---|---|
| 4,4'-Bis(4-hydroxyphenyl)pentanoic acid | 60 g. |
| Styrene-acrylonitrile-indene copolymer | 268 g. |
| Phenolic resin | 32 g. |
| Myristic acid dodecyl amide | 18 g. |
| Aerosil | 18 g. |

Following the procedure of Example 51, the above mentioned components were made into a liquid developer.

The electrostatic latent image was developed by the resulting liquid developer to form a colorless image on the organic photoconductive layer and heated and melted to produce a transparent blue visible image.

EXAMPLE 54

The organic photoconductive film obtained in Example 41 was subjected to corona charging of −6KV and imagewise exposure to form an electrostatic latent image.

A developer was prepared by the following procedure.

| | |
|---|---|
| 4-Phenyl phenol | 60 g. |
| Polystyrene | 270 g. |
| Phenol aldehyde resin | 32 g. |
| Diphenyl phthalate | 18 g. |
| Aerosil | 17 g. |

The above mentioned components were mixed and ground for 25 hours by a ball mill, sufficiently melted and kneaded by a roll mill, cooled and roughly ground by a hammer mill and then pulverized by a jet mill and then classified to obtain powders of 5 - 20 microns in size and the powder thus classified was used as a toner. The resulting toner was mixed with 5 - 6% of carrier iron powder (200 - 400 mesh) to produce a dry developer. The electrostatic latent image on the organic photoconductive layer was developed by the resulting developer according to magnet brush development.

The colorless image formed on the organic photoconductive layer was heated and melted to produce a transparent blue visible image.

EXAMPLE 55

The organic photoconductive film obtained in Example 42 was subjected to corona charging of −6KV and imagewise exposure to form an electrostatic latent image.

A developer was prepared by the following procedure.

| | |
|---|---|
| 4-Hydroxydiphenyl oxide | 60 g. |
| Styrene-acrylic acid ethyl ester copolymer | 272 g. |
| Phenolic resin | 33 g. |
| Lead palmitate | 17 g. |
| Aerosil | 18 g. |

Following the procedure of Example 54, a developer was obtained by using the components.

The electrostatic latent image was developed by using the resulting developer according to magnetic brush development, and the resulting colorless image on the organic photoconductive layer was heated and melted to produce a transparent blue visible image.

EXAMPLE 56

The organic photoconductive film obtained in Example 43 was subject to corona charging of −6KV and imagewise exposure to form an electrostatic latent image.

A developer was prepared by the following procedure.

| | |
|---|---|
| 4-Hydroxyacetophenol | 60 g. |

-continued

| | |
|---|---|
| Styrene-acrylonitrile copolymer | 273 g. |
| Styrene-maleic anhydride copolymer | 34 g. |
| Ethyl laccerate | 18 g. |
| Aerosil | 18 g. |

Following the procedure of Example 54, a developer was obtained. The electrostatic latent image was developed by the resulting developer according to magnetic brush development. The colorless image formed on the organic photoconductive layer was heated and melted to produce a transparent blue visible image.

EXAMPLE 57

The organic photoconductive film obtained in Example 44 was subjected to corona charging of −6KV and imagewise exposure to form an electrostatic latent image.

A liquid developer was prepared by the following procedure.

| | |
|---|---|
| 4-t-Butylphenol | 60 g. |
| Styrene-butadiene copolymer | 274 g. |
| Rosin-modified maleic acid resin | 32 g. |
| Ethylene glycol dibenzoate | 18 g. |
| Aerosil | 18 g. |

Following the procedure of Example 54, there was obtained a developer, which was used to develop the electrostatic latent image. The colorless image produced on the organic photoconductive layer was heated and melted to produce a transparent green visible image.

EXAMPLE 58

The organic photoconductive film obtained in Example 45 was adjusted to corona charging of −6KV and imagewise exposure to form an electrostatic latent image.

A liquid developer was prepared by the following procedure.

| | |
|---|---|
| 4,4-Isopropylidene diphenyl | 60 g. |
| Polystyrene | 270 g. |
| Phenolic resin | 32 g. |
| Stearic acid | 18 g. |
| Aerosil | 18 g. |

The above components were dissolved and dispersed in 3 liters of MEK and then dispersed in 15 litres of an insulating liquid (Isopar H) and then finely dispersed for 30 - 40 min. by attritor dispersing machine. To the resulting fine dispersion liquid was added further the above-mentioned insulating liquid to produce a 5% (solid matter) dispersion liquid, which was used as a liquid developer.

The resulting liquid developer was used to develop the above-mentioned electrostatic latent image. The colorless image formed on the organic photoconductive layer was heated and melted to produce a transparent red visible image.

EXAMPLE 59

The organic photoconductive film obtained in Example 46 was subjected to corona charging of −6KV and imagewise exposure to form an electrostatic latent image.

A liquid developer was prepared by the following procedure.

| | |
|---|---|
| 4,4'-Bis(hydroxyphenyl) butyric acid | 60 g. |
| Styrene-acrylonitrile copolymer | 270 g. |
| Phenolic resin | 33 g. |
| Glycerol palmitate | 18 g. |
| Aerosil | 18 g. |

The above materials were dissolved in 1 liter of acetone and 2.5 liters of MEK and dispersed in 5 liters of an insulating liquid (Isopar H), filtered once by sucking, dispersed again in 10 liters of an insulating liquid, and finely dispersed by attritor dispersing machine. Further, the resulting dispersion was diluted to 5% (solid matter) to produce a developer.

The resulting liquid developer was used to develop the electrostatic latent image. The colorless image formed on the organic photoconductive layer was heated and melted to produce a transparent yellowish red visible image.

EXAMPLE 60

The organic photoconductive film obtained in Example 47 was subjected to corona charging of −6KV and imagewise exposure to form an electrostatic latent image.

A developer was prepared by the following procedure.

| | |
|---|---|
| 4,4'-Isopropylidene diphenyl | 60 g. |
| Polyester resin | 270 g. |
| Phenolic resin | 33 g. |
| Lead laurate | 18 g. |
| Aerosil | 18 g. |

The above ingredients were treated in a way similar to Example 59 to produce a liquid developer, which was used to develop the above mentioned electrostatic latent image. The colorless image formed on the organic photoconductive layer was heated and melted to produce a transparent green visible image.

EXAMPLE 61

The organic photoconductive film obtained in Example 48 was subjected to corona charging of −6KV and imagewise exposure to form an electrostatic latent image.

A developer was prepared by the following procedure.

| | |
|---|---|
| 4,4-Bis(hydroxyphenyl) butyric acid | 60 g. |
| Epoxy resin | 273 g. |
| Phenolic resin (RB-100) | 32 g. |
| Melissic acid | 18 g. |
| Aerosil (#200) | 18 g. |

The above ingredients were treated in a way similar in Example 54 to produce a dry toner, which was used to develop the electrostatic latent image. The colorless image formed on the organic photoconductive layer was heated and melted to produce a transparent red visible image.

EXAMPLE 62

The organic photoconductive film obtained in Example 49 was subjected to corona charging of −6KV and imagewise exposure to form an electrostatic latent image.

A developer was prepared by the following procedure.

| | |
|---|---|
| 4,4'-Isopropylidene diphenyl | 60 g. |
| Polyamide | 270 g. |
| Phenolic resin | 32 g. |
| Capric acid anilide | 18 g. |
| Aerosil | 18 g. |

The above materials were treated in a way similar to Example 54 to obtain a dry developer, which was used to develop the electrostatic latent image. The colorless image formed on the organic photoconductive layer was heated and melted to produce a transparent red visible image.

EXAMPLE 63

The organic photoconductive film obtained in Examples ;b 39 - 50 was subjected to corona charging of −6KV and imagewise exposure to form an electrostatic latent image.

Then, the electrostatic latent image was developed by a liquid developer as used in Example 51. The colorless image produced on each organic photoconductive layer was heated and melted, and a transparent blue, green, red and yellowish red visible image was obtained when an organic photoconductive film of Examples 39 - 43, Examples 44 and 47, Examples 45, 48 and 49, and Examples 46 and 50, respectively.

In the following, there are given examples of a printing method using the electrophotographic method according to the present invention.

EXAMPLE 64

| | |
|---|---|
| 4,4'-Isopropylidene diphenyl | 20 parts |
| Polystyrene | 100 parts |
| Phenolic resin (RB-100, trade name, supplied by Mitsui-Toatsu) | 10 parts |
| Stearic acid | 2 parts |
| Aerosil (#200, supplied by DEGUSSA) | 7 parts |

The above materials were mixed and ground for 24 - 30 hours by a ball mill, sufficiently melted and kneaded by a roll mill, cooled, roughly ground to a size of about 1 mm. by a hammer mill, and further pulverized by a pulverizer of air-jet type. The resulting finely divided powders were classified by a pressure classifier to select fine powders of less than 10 microns in size, which were then used as a toner. Iron powder (as carrier) was mixed with the toner in an amount of 8 - 50 parts, preferably, 10 - 20 parts, per one part of toner. The iron powder was of 20 - 75 microns, preferably, 25 - 40 microns, in size. There was used a printing paper produced by coating a paper with Crystal Violet Lactone (CVL) together with an appropriate binder.

The whole surface of a photoconductive member comprising zinc oxide and a binder resin was subjected to negative charging, exposed to a light and shadow pattern and passed through a developing device. The toner particles attached to a negatively charged portion. Toner image on a zinc oxide paper as a master sheet was transferred to a printing paper having a coating of Crystal Violet Lactone (CVL) by heating and pressing using a device as shown in FIG. 6 to produce a blue image on the printing paper. The above procedure was repeated and 20 sheets of good copy were obtained. The twentieth copy is as good as the first copy.

EXAMPLE 65

There were used the same developer and image receiving sheet as those in Example 64. A toner image was produced on a rotary drum having a selenium layer as a photoconductive photosensitive layer by a conventional process comprising charging, exposing, and developing. The resulting toner image was contacted with a Crystal Violet Lactone layer softened by heating on a printing paper to produce a good image. 15 sheets of good copy were obtained from the same master sheet by the same process.

EXAMPLE 66

| | |
|---|---|
| **4,4'-Bis(hydroxyphenyl) butyric acid** | 22 parts |
| Phenolic resin | 9 parts |
| Styrene-butadiene copolymer resin | 100 parts |
| Stearic acid | 2.5 parts |
| Aerosil | 6 parts |

Following the procedure of Example 64, a toner was prepared from the above components.

The resulting toner was dispersed in Isopar H (trade name, supplied by ESSO Standard Oil) to produce a liquid developer. An electrostatic latent image (mirror image of the original image) was produced on a ZnO paper by the same method as Example 64 comprising negatively charging and exposing and developed in a liquid developer. The resulting toner image on the ZnO paper was transferred to a transferring paper composed of a printing paper having a Rhodamine Lactone (RL) coating as in Example 64. In a way similar to Example 64 there was obtained a good red colored image. Further, 20 sheets of good copy were obtained.

EXAMPLE 67

| | |
|---|---|
| **4,4'-(4-hydroxyphenyl)pentanoic acid** | 18 parts |
| Epoxy resin | 90 parts |
| Phenolic resin | 10 parts |
| Myristic acid | 2 parts |
| Aerosil (#200) | 5 parts |
| The above ingredients were treated in a way similar to Example 64 to produce a toner. | |
| Malachite Green Lactone (MGL) | 50 parts |
| Stearic acid | 50 parts |
| Polyvinylalcohol (PVA) | 400 parts |
| Water | 1200 parts |
| Emanone (trade name, supplied by Kao Sekken) | 13 parts |
| Polyvinylpyrrolidone (PVPK-30, trade name) | 2 parts |

The above components were coated on a paper to produce a printing paper. The coating is effected in such a way that the amount of Malachite Green Lactam was 1.0 g./m$^2$.

In a way similar to Example 64, there were obtained 15 sheets of green image copy.

Example 68 A photosensitive member composed of a polyester film wound on a photoconductive selenium (as an insulating film) was charged in a known method and selectively discharged to form a latent image.

| | |
|---|---|
| 4-Phenyl phenol | 20 parts |
| Polyamide resin | 100 parts |
| Phenol-aldehyde copolymer resin | 9 parts |
| Myristic acid | 3 parts |
| Aerosil | 6 parts |

A mixture of the above materials was melted, ground and classified to obtain powders of 1 - 20 microns in size, which were used as a toner.

The latent image was developed by the toner according to magnet development to produce a master sheet. A printing paper coated with Crystal Violet Lactone was used in a way similar to that shown in FIG. 6 to produce a blue image on the printing paper. Repeating the procedure, 20 sheets of copy were obtained.

EXAMPLE 69

Three sheets of photoconductive ZnO paper were negatively charged. The first ZnO paper was exposed through a red filter, the second ZnO paper was exposed through a green filter and the third ZnO paper was exposed through a blue filter to produce each electrostatic latent image, which was developed with a developer of Example 64 to produce each toner image.

The following composition was coated on a polyethylene terephthalate film subjected to a treatment for imparting hydrophilic property to produce Printing paper I.

| | | |
|---|---|---|
| I | Crystal Violet Lactone | 40 parts |
| | Myristic acid | 40 " |
| | Polyvinylalcohol | 400 " |
| | Water | 1200 " |
| | Emanone (trade name, supplied by Kao Sekken) | 10 " |
| | Polyvinylpyrrolidone | 2 " |

Printing papers II and III were produced by using Rhodamine Lactam and Leuco Auramine, respectively, in place of Crystal Violet Lactone in Printing paper I. The toner image on the first ZnO paper was contacted with the Printing paper I to conduct transferring printing by the device in FIG. 6 to produce a transparent blue image. In a similar manner, the second and the third ZnO papers were contacted with Printing papers II and III, to produce transparent red and yellow images, respectively.

There was obtained a multicolor image by combining these three transparent images. About 10 sheets of the multicolor copy were obtained.

We claim:

1. A toner image receiving sheet for producing a low-temperature, heat fixed color image from a colorless or light colored toner image containing a color forming agent (A), said receiving sheet consisting essentially of:

a color forming agent (B) selected from the group consisting of diarylphthalides. leuco auramines, acryl auramines, $\alpha,\beta$-unsaturated arylketones, basic monoazo dyestuff, rhodamine B lactone, polyaryl carbinols, benzoindolino spiropyrans, phthalans and spirophthalans;

a material having a melting point ranging from 40°-130° C selected from the group consisting of fatty acid, fatty acid metal salt, fatty acid esters, fatty acid amide, fatty acid anilide and solid plasticizer; and a paper sheet or web support associated with said color forming agent (B) and said material having a melting point ranging from 40°- 130° C;

wherein said receiving sheet contains between 25 - 130 parts of said material having a melting point ranging from 40°- 130° C per 50 parts of said coloring forming agent; and wherein said color forming agent (B) is adapted to react with said color forming agent (A) in said toner image upon heating to produce said low-temperature, heat-fixed colored image.

2. A toner image receiving sheet according to claim 1 including a binder.

3. A toner image receiving sheet according to claim 1 in which the diarylphthalide is selected from the group consisting of 3,3-bis (p-dimethylaminophenyl)-6-dimethylaminophthalide and 3,3-bis (p-dimethylaminophenyl) phthalide.

4. A toner image receiving sheet according to claim 1 in which the fatty acid has not less than 12 carbon atoms and a melting point ranging from 40° to 100° C.

5. A toner image receiving sheet according to claim 1 in which the fatty acid is selected from the group consisting of lauric acid, tridecylic acid, myristic acid, pentadecylic acid, palmitic acid, heptadecylic acid, stearic acid, nonadecanoic acid, arachic acid, behenic acid, lignoceric acid, cerotic acid, heptacosanoic acid, montanic acid, melissic acid and lacceric acid.

6. A toner image receiving sheet according to claim 1 in which the metal of the fatty acid metal salt is selected from the group consisting of Be, Mg, Ba, Zn, Cd, Hg, Al, T1, and Pb.

7. A toner image receiving sheet according to claim 1 in which the fatty acid amide is selected from the group consisting of fatty acid methyl amide and fatty acid dodecyl amide.

8. A toner image receiving sheet according to claim 1 in which the fatty acid ester is selected from the group consisting of methyl ester, ethyl ester, phenyl ester, glycol ester and glycerine ester of fatty acid.

9. A toner image receiving sheet according to claim 1 in which the solid plasticizer is selected from the group consisting of diphenylphthalate, dicyclohexylphthalate, ethylene glycol dibenzoate and dimethyl isophthalate.

10. A toner image receiving sheet according to claim 1 including 40 - 60 parts of the material having a melting point of 40° to 130° C per 50 parts of the color forming agent.

11. A toner image receiving sheet according to claim 2 in which the binder is selected from the group consisting of acetylized starch, styrene-butadiene latex, polyvinyl pyrrolidone, acryl latex, polyvinyl alcohol, soy albumin, casein, oxyethylized starch and mixtures thereof.

12. A toner image receiving sheet according to claim 1 including an ultraviolet ray absorber.

13. A toner image receiving sheet according to claim 12 in which the ultraviolet ray absorber is a benztriazole series compound.

* * * * *